US006220121B1

(12) United States Patent
Leete

(10) Patent No.: US 6,220,121 B1
(45) Date of Patent: Apr. 24, 2001

(54) MULTI-PURPOSE FRAMING TOOL

(76) Inventor: Gary Maxwell Leete, 1 Yeoman Court, Park Orchards, VIC 3134 (AU)

( * ) Notice: Subject to any disclaimer, the term of this patent is extended or adjusted under 35 U.S.C. 154(b) by 0 days.

(21) Appl. No.: 09/125,893

(22) PCT Filed: Jul. 2, 1997

(86) PCT No.: PCT/AU97/00417

§ 371 Date: Mar. 19, 1999

§ 102(e) Date: Mar. 19, 1999

(87) PCT Pub. No.: WO98/01261

PCT Pub. Date: Jan. 15, 1998

(30) Foreign Application Priority Data

Jul. 4, 1996 (AU) ..... PO 0828
Nov. 12, 1996 (AU) ..... PO 3564

(51) Int. Cl.[7] ..... B25C 3/00
(52) U.S. Cl. ..... 81/44; 901/23
(58) Field of Search ..... 81/44, 487, 490, 81/492, 901, 23, 463; 227/113, 147; 29/275

(56) References Cited

U.S. PATENT DOCUMENTS 1,185,190 * 5/1916 Fitzgerald et al. ..... 81/44
1,240,473 * 9/1917 Moffat ..... 81/44
3,979,040 9/1976 Denin .
4,120,438 10/1978 Litch .
5,605,271 * 2/1997 Russell ..... 227/147

FOREIGN PATENT DOCUMENTS 246327 9/1947 (CH) .
195 30 681 1/1996 (DE) .
0 060 158 9/1982 (EP) .
0 075 330 3/1983 (EP) .
1190263 10/1959 (FR) .
2 180 405 3/1987 (GB) .

OTHER PUBLICATIONS

Derwent Abstract No. 96–204162/21, Class P62, JP 08071952A (Yamaura), Mar. 19, 1996.

* cited by examiner

*Primary Examiner*—D. S. Meislin
(74) *Attorney, Agent, or Firm*—Larson & Taylor, PLC

(57) ABSTRACT

A hand-held framing tool allows for insertions of nails into picture frames and the like. The tool includes a spring actuated magnet in the central bore of the tool, a portion of the magnet extending forwardly of an anvil head and adapted to received and retain "V" nails for joining the comers of the frame. The anvil head also includes at least one blind groove or slot for receiving the head portion of a nail or flexi-point which is held by the magnet. All nails are inserted into the work by the anvil as the tool is pushed forward toward the work surface and the magnet is pushed into the bore.

12 Claims, 2 Drawing Sheets

MULTI-PURPOSE FRAMING TOOL

This invention relates to a multi-purpose framing tool and refers more specifically to a hand held tool for inserting nails into picture frames and the like to secure the sides of the frame in the assembled state and for securing the finished work in the frame.

It is known to use a bench mounted press for the insertion of "V" nails in the corner of frames to securely connect the sides and ends of the frame and there are also tools which insert nails and flexi-points into the sides of the frame to hold the work in the frame. However, such machines, especially those for the insertion of "V" nails, are reasonably expensive and therefore are generally only used by professional framing organizations. They are also required to be affixed to a bench, work table, or they may be free standing and are not readily portable.

It is an object of my invention to provide a hand-held tool which is inexpensive, readily portable and which is capable of carrying out both of the aforementioned operations.

A further object is to provide a tool which is also capable of applying supporting screws and other hanging or hinging devices for the picture wire thereby being of particular benefit to hobby framers and the like.

According to one form of the invention, a hand-held framing tool comprises means for retaining fasteners to be applied to a work surface and an anvil head for driving said fasteners thereinto, the retaining means being displaceably located in a bore of said anvil head and having a portion extending forwardly of said anvil head, said forwardly extending portion of said retaining means being adapted to receive and retain a fastener against said anvil head and being retractable in said anvil head against biasing means to permit the anvil head to drive said fastener into the work surface, either of said anvil head or retaining means being a magnet.

A further feature of the invention resides in the provision of a chamfer on at least one side of said anvil head, said anvil head having a blind slot or groove in or adjacent said chamfer.

A still further preferred feature of the invention resides in the provision of a chamfer on opposite sides of said anvil head, each said chamfer having a blind slot or groove in or adjacent thereto.

Another feature of the invention resides in the provision of a slot or slots in the anvil head to receive and retain screw-eyes or other retaining devices for insertion in the rear of the frame to facilitate attachment of a support wire or the like.

Other features of the invention will become apparent from the following description wherein reference is made to the accompanying drawings illustrating one form of the invention which may be preferred and in which.

Figure 1:
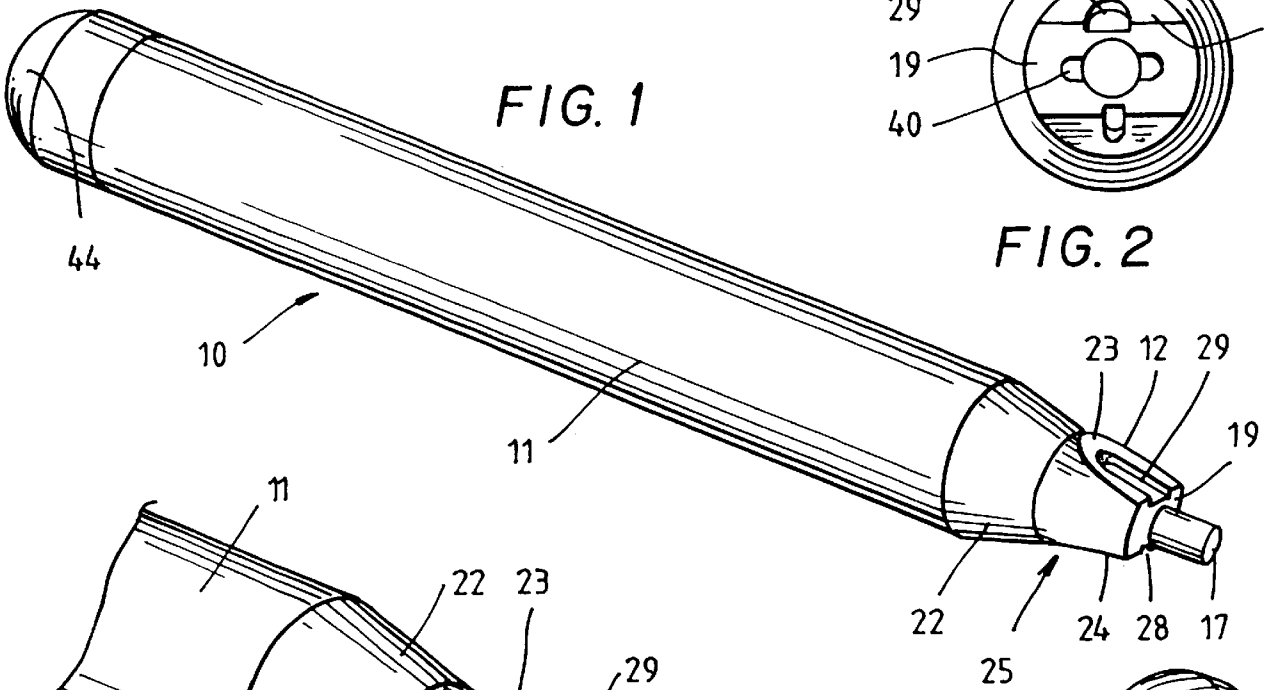
FIG. 1 is a perspective view of a framing tool according to this invention.
Figure 7:
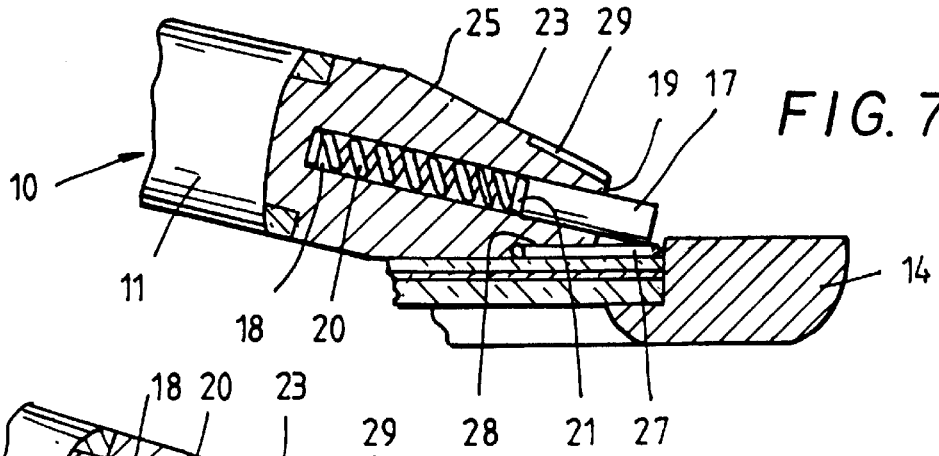
FIG. 7 is a part sectional view illustrating the head of the tool preparatory to inserting a nail in the side of a frame.
Figure 8:
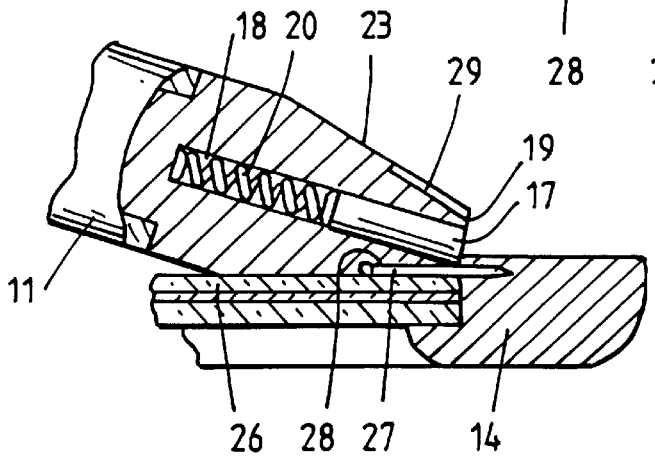
FIG. 8 is a view similar to FIG. 4 illustrating the nail inserted.
Figure 9:
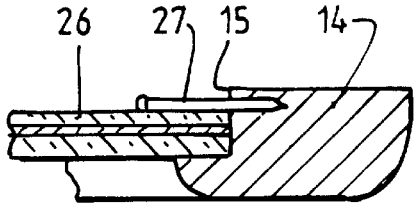
FIG. 9 is a view similar to FIG. 8 after the tool has been withdrawn.
Figure 10:
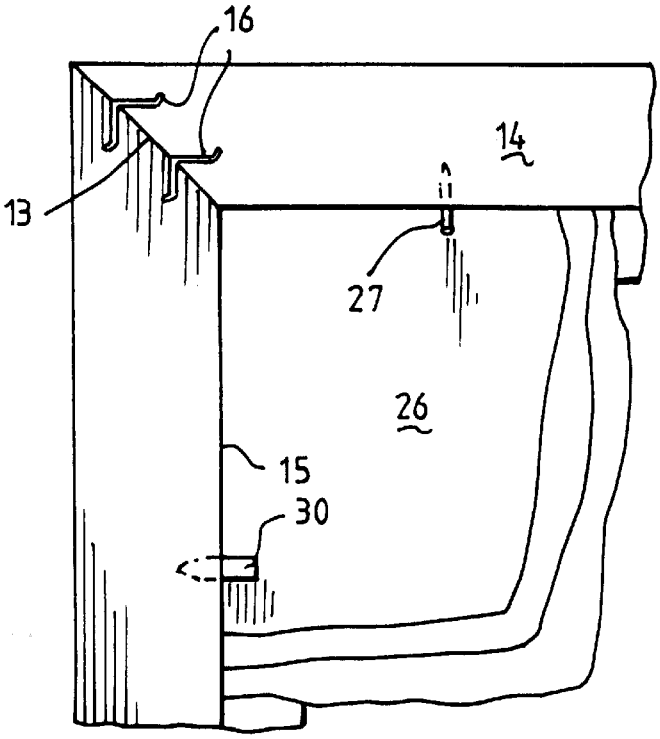
FIG. 10 is a rear view of a frame assembled by the tool of this invention.

Referring now to the drawings, a hand-held framing tool is shown generally at 10 in FIG. 1, the tool having a cylindrical body portion 11 which may be readily held in the hand of an operator and an anvil head portion 12 for retaining nails for insertion into a work surface such as the corners 13 of a frame 14 as shown in FIG. 10 or the inner side surface 15 of a frame 14 as shown in FIGS. 7 to 9.

Figure 4:
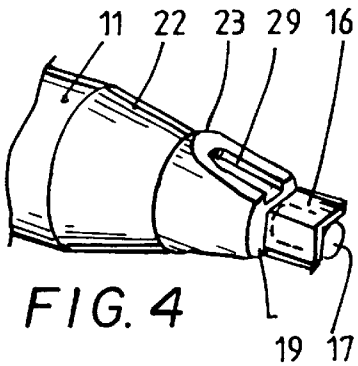
FIG. 4 is a detailed view of the head of the tool of FIG. 1 as seen from one side.

As maybe seen a "V" nail 16 is applied to a retaining device, preferably a cylindrical magnet 17 mounted in a central bore 18 of said head portion 12. Alternatively, the anvil head 19 may be magnetized. The magnet is adapted to project forwardly of an anvil surface 19 a distance sufficient to allow a "V" nail to be applied thereto as shown in FIG. 4. A compression spring 20 is placed in the bore 18 to act against the rear inner end 21 of the magnet 17 to return the magnet to its position as shown in FIGS. 1, 4 and 7 after a nail has been inserted in the work. As the anvil 19 engages the "V" nail 16 and applies a force thereto, the magnet 17 is forced into the bore 18 against the pressure of the spring 20 thereby allowing the anvil to engage the work surface and fully insert the "V" nail therein. As the anvil is withdrawn from the work surface, the spring 20 causes the magnet 17 to slide outwardly of the bore 18 to its nail receiving position.

Referring now in particular to FIGS. 4, 5, 7 and 8, the head 12 of the tool is bevelled at 22 and the angle of the bevel or chamfer is continued along opposite sides 23, 24 of the anvil head to provide a continuous angled surface 25 which allows the head 12 to lie flat against a surface such as the backing 26 of a picture or similar frame for the insertion of a nail 27 into the inner side surface 15 of the frame 14. The nail 27 is placed in a groove 28 which is provided in the chamfered side 24 of the head, the groove 28 being of a depth and length to receive the head portion of the nail and to allow the point of the nail to project forwardly of the anvil 19 as shown best in FIG. 7. The nail is held in the groove by the magnet. As the anvil is pushed forwardly against the work, the blind end of the groove 28 acting on the head of the nail 27, forces the nail into the work as seen in FIGS. 8 and 9.

Similarly, the opposite chamfered surface 23 is provided with a blind slot 29 which is adapted to receive and retain a flexi-point 30 for insertion in a frame in the same manner as the nail 27. All that is required, is to turn the tool through 180°. By providing for the insertion of a standard nail and a flexi-point, the tool is adapted for all framing requirements.

Figure 3:
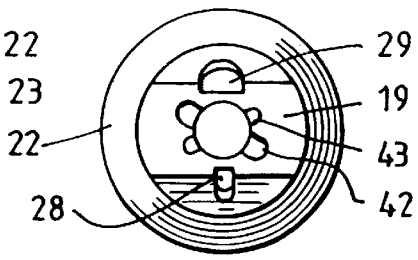
FIG. 3 is an end elevation of a modification of the head of the tool of FIG. 2.
Figure 2:
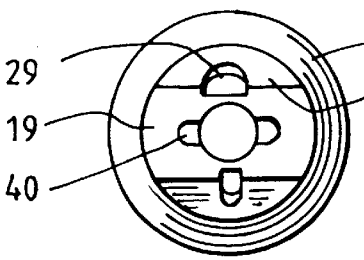
FIG. 2 is an end elevational view of the head of a tool incorporating a slot for a screw-eye.
Figure 5:
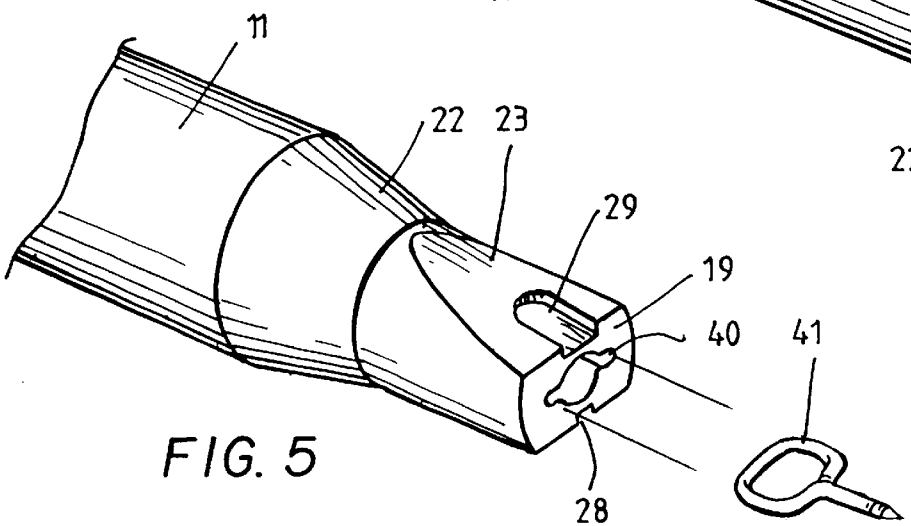
FIG. 5 is an exploded view, showing use of the tool for the insertion of a screw-eye.

As shown in FIGS. 2, 3 and 5, the anvil 19 is additionally provided with a blind slot 40 adapted to receive the head of a square head screw-eye 41 whereby the tool can insert the screw-eye 41 in the rear of the frame 14 for the attachment of a wire or the like. So as to allow for the receipt of the screw-eye in the slot 40, the magnet 17 and spring 20 are removed from the tool. As shown in FIG. 3, two diagonal slots 42 and 43 of different dimensions are provided for the retention of screw-eyes of different sizes. This feature enables the operator to insert the screw-eyes without the need to use a gimlet to first make a hole for the screw-eye.

Figure 6:
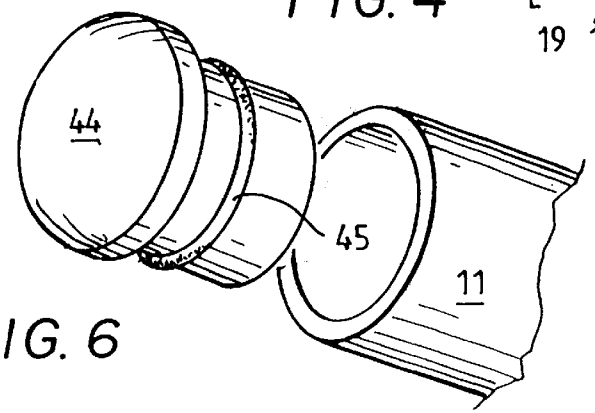
FIG. 6 is an exploded view of the top of the tool showing the cap removed.

A further feature of the invention is shown in FIG. 6 wherein the cap 44 of the tool is removable from the body 11, which, as shown is hollow to allow for the storage of nails, screw-eyes or the like. The cap is prevented from accidental withdrawal by the provision of an "O" ring 45 which acts as a seal for the cap 44. Removal of the cap 44 also enables the tool to be attached to another tool such as a bench press or the like thereby allowing the tool to be used as a mechanical device.

It will thus be seen that the present invention provides a portable hand-held multi-purpose framing tool which is capable of securing the sides and ends of a frame by "V" nailing the adjoining corners of the frame as well as being capable of securing the framed work by means of insertion of nails or flexi-points into the inner rear sides of the frame adjacent the surface of the backing of the framed work and screw-eyes into the rear of the frame for the attachment of a support wire.

What is claimed is:

1. A hand-held framing tool comprising means for retaining fasteners to be applied to a work surface and an anvil head having a front surface for driving said fasteners thereinto, the retaining means being displaceably located in a bore of said anvil head against resilient biasing means such that a portion of said retaining means extends forwardly of said front surface of said anvil head when said retaining means is in a normal extended position, said forwardly extending portion of said retaining means being adapted to receive and retain a fastener against said anvil head and being, in use, retractable into said anvil head against the biasing means to permit the anvil head to drive said fastener into the work surface, one of said anvil head and said retaining means comprising a magnet.

2. A hand-held framing tool as claimed in claim 1, wherein said retaining means comprises a cylindrical magnet and the bore is central of said anvil head.

3. A hand-held framing tool as claimed in claim 1, wherein said resilient biasing means comprises a compression spring positioned within the bore.

4. A hand-held framing tool as claimed in claim 1, further comprising a chamfer on at least one side of said anvil head.

5. A hand-held framing tool as claimed in claim 4, wherein said anvil head includes a blind slot in said chamfer to receive one end of the fastener.

6. A hand-held framing tool as claimed in claim 4, comprising two chamfers positioned respectively on opposite sides of said anvil head, each said chamfer having a blind slot therein to receive one end of the fastener.

7. A hand-held framing tool as claimed in claim 1, wherein an end of the tool opposite the anvil head includes a removable cap to facilitate storage of fasteners or other materials and to facilitate attachment of said tool to another tool for mechanical operation.

8. A hand-held framing tool as claimed in claim 7, further comprising an "O" ring acting as a seal between said cap and the body of said tool for preventing accidental removal of said cap.

9. A hand-held framing tool as claimed in claim 7, wherein said cap is threadedly attached to said tool.

10. A hand-held framing tool as claimed in claim 1, wherein the anvil head includes means for receiving and retaining a frame supporting device to facilitate the insertion of said device in said frame.

11. A hand-held framing tool as claimed in claim 10, wherein said means for receiving and retaining comprises a blind slot in a face of said anvil head.

12. hand-held framing tool as claimed in claim 10, Wherein said means for receiving and retaining comprises two diagonal blind slots having different dimensions in a front face of said anvil head.

* * * * *